US010158192B1

(12) United States Patent
Yokotani et al.

(10) Patent No.: US 10,158,192 B1
(45) Date of Patent: Dec. 18, 2018

(54) CONNECTOR INCLUDING WATER-PENETRATING WALL

(71) Applicants: Sumitomo Wiring Systems, Ltd., Yokkaichi-shi, Mie (JP); Toyota Jidosha Kabushiki Kaisha, Toyota-shi, Aichi (JP)

(72) Inventors: Koichi Yokotani, Yokkaichi (JP); Yusuke Sakamoto, Okazaki (JP)

(73) Assignees: Sumitomo Wiring Systems, Ltd. (JP); Toyota Jidosha Kabushiki Kaisha (JP)

( * ) Notice: Subject to any disclaimer, the term of this patent is extended or adjusted under 35 U.S.C. 154(b) by 0 days.

(21) Appl. No.: 15/778,050

(22) PCT Filed: Nov. 17, 2016

(86) PCT No.: PCT/JP2016/084118
§ 371 (c)(1),
(2) Date: May 22, 2018

(87) PCT Pub. No.: WO2017/098885
PCT Pub. Date: Jun. 15, 2017

(30) Foreign Application Priority Data

Dec. 8, 2015 (JP) ..... 2015-239198

(51) Int. Cl.
*H01R 13/52* (2006.01)
*H01R 13/6593* (2011.01)
(Continued)

(52) U.S. Cl.
CPC ..... *H01R 13/5219* (2013.01); *H01R 13/42* (2013.01); *H01R 13/6593* (2013.01); *H01R 13/74* (2013.01)

(58) Field of Classification Search
CPC ..... H01R 13/5202; H01R 13/6596; H01R 13/5221
(Continued)

(56) References Cited

U.S. PATENT DOCUMENTS 4,676,575 A 6/1987 Denlinger et al.
6,261,108 B1 * 7/2001 Kanagawa ..... H01R 13/6592 439/98
(Continued)

FOREIGN PATENT DOCUMENTS

JP 63-503492 12/1988
JP 2013-171620 9/2013
JP 2015-095357 5/2015

OTHER PUBLICATIONS

International Search Report and Written Opinion dated Feb. 14, 2017.
(Continued)

*Primary Examiner* — Tulsidas C Patel
*Assistant Examiner* — Marcus Harcum
(74) *Attorney, Agent, or Firm* — Gerald E. Hespos; Michael J. Porco; Matthew T. Hespos

(57) ABSTRACT

A connector 1 configured to be attached to a device 2 is provided with: an annular housing 11 configured to be attached to the device 2 in such a position as to annularly rise from the device 2; an annular seal member 22 that seals a space between an end surface of the housing 11 facing the device 2 and the device 2 in a watertight manner; and a water-preventing wall 25 that extends from the housing 11 toward the device 2 outside the seal member 22, and that protects the seal member 22 from high-pressure water externally sprayed toward the housing 11.

2 Claims, 5 Drawing Sheets

(51) Int. Cl.
*H01R 13/74* (2006.01)
*H01R 13/42* (2006.01)

(58) Field of Classification Search
USPC ..... 439/587, 588
See application file for complete search history.

(56) References Cited

U.S. PATENT DOCUMENTS

| | | | | |
|---|---|---|---|---|
| 8,152,574 | B2 * | 4/2012 | Matsuoka | H01R 4/302 439/587 |
| 8,979,554 | B2 * | 3/2015 | Yudate | H01R 13/5202 439/271 |
| 9,208,922 | B2 | 12/2015 | Yoshida et al. | |
| 9,674,994 | B2 * | 6/2017 | Yoshida | H01R 13/6593 |
| 9,887,479 | B2 * | 2/2018 | Mukuno | H01R 13/245 |
| 2004/0057187 | A1 * | 3/2004 | Kuboshima | H01R 9/032 361/118 |
| 2014/0295709 | A1 * | 10/2014 | Tanaka | H01R 13/405 439/626 |
| 2018/0175532 | A1 * | 6/2018 | Mukuno | H01R 13/15 |

OTHER PUBLICATIONS

Written Opinion of the International Searching Authority dated Sep. 12, 2017.
Japanese Office Action dated Sep. 14, 2017.
International Preliminary Examination Report on Patentability dated Dec. 12, 2017.

* cited by examiner

CONNECTOR INCLUDING WATER-PENETRATING WALL

BACKGROUND

Field of the Invention

The technology disclosed in the present description relates to a connector.

Description of the Related Art

Japanese Unexamined Patent Publication No. 2015-95357 discloses a connector with an annular housing configured to be attached to a device in such a position as to rise annularly from the device, and an annular seal member seals a space between an end surface of the housing facing the device and the device in a watertight manner.

Specifically, a second shield connector described in Japanese Unexamined Patent Publication No. 2015-95357 attaches to an inverter case (corresponding to the device), and includes a synthetic resin second housing (corresponding to the annular housing). The second housing has an end surface facing the case to which a second seal ring (corresponding to the annular seal member) is fittingly mounted. The second seal ring seals the space between the second housing and the case.

A connector may be attached to a device mounted on a vehicle. The vehicle may be washed using high-pressure water once in a while. Accordingly, the connector attached to the device mounted on the vehicle may be sprayed with high-pressure water during the washing. When the connector is sprayed with high-pressure water, the seal member could be directly exposed to the high-pressure water via a gap between the housing and the device.

The present description discloses a technology for preventing a seal member sealing a space between a connector housing and a device from being directly exposed to high-pressure water.

SUMMARY

This disclosure relates to seal cover and to a connector configured to be attached to a device. The connector includes an annular housing configured to be attached to the device in such a position as to rise annularly from the device. An annular seal member seals a space between an end surface of the housing facing the device and the device in a watertight manner. A water-preventing wall extends from the housing toward the device outside the seal member, and protects the seal member from high-pressure water externally sprayed toward the housing.

The connector is provided with the water-preventing wall that protects the seal member from high-pressure water. Thus, the seal member sealing the space between the connector housing and the device can be prevented from being directly exposed to high-pressure water. In this way, the probability of the seal member becoming detached or degraded due to high-pressure water can be decreased.

The device may include a seal press-contacted surface that the seal member press-contacts, and an outer wall surface continuous with the seal press-contacted surface. The water-preventing wall may be provided at a position outside the outer wall surface with the housing attached to the device, and may shield, as viewed in a direction perpendicular to a central axis of the seal member, a gap between the housing and the device, and an edge portion of the outer wall surface on the seal press-contacted surface side.

The connector makes it possible to prevent the seal member from being exposed directly to water when the high-pressure water is sprayed onto the connector in a direction perpendicular to the central axis of the seal member.

The housing may be made of resin, and the connector may further include an electric wire integrally molded in the housing so as to penetrate through a wall of the housing. A metal plate may be fixed to the device with the housing being all around pressed toward the device. A rib may be provided along an outer peripheral portion of the metal plate, with the outer peripheral portion not overlapping the electric wire as viewed in a direction perpendicular to a plate surface of the metal plate. The metal plate may not have a rib in an outer peripheral portion overlapping the electric wire as viewed in a direction perpendicular to the plate surface. The water-preventing wall may be provided at least in a section in which the electric wire is integrally molded in the circumferential direction of the housing.

The connector makes it possible to prevent the seal member from being directly exposed to high-pressure water, and to pinch the electric wire when the electric wire is integrally molded in the housing.

The seal cover disclosed in the present description makes it possible to prevent a seal member sealing a space between a connector housing and a device from being directly exposed to high-pressure water.

DETAILED DESCRIPTION

An embodiment will be described with reference to FIG. 1 to FIG. 5. In the following description, front and rear directions and right and left directions are to be considered with reference to the front and rear directions and the right and left directions shown in FIG. 1, and upper and lower directions are to be considered with reference to the upper and lower directions shown in FIG. 2.

Figure 1:
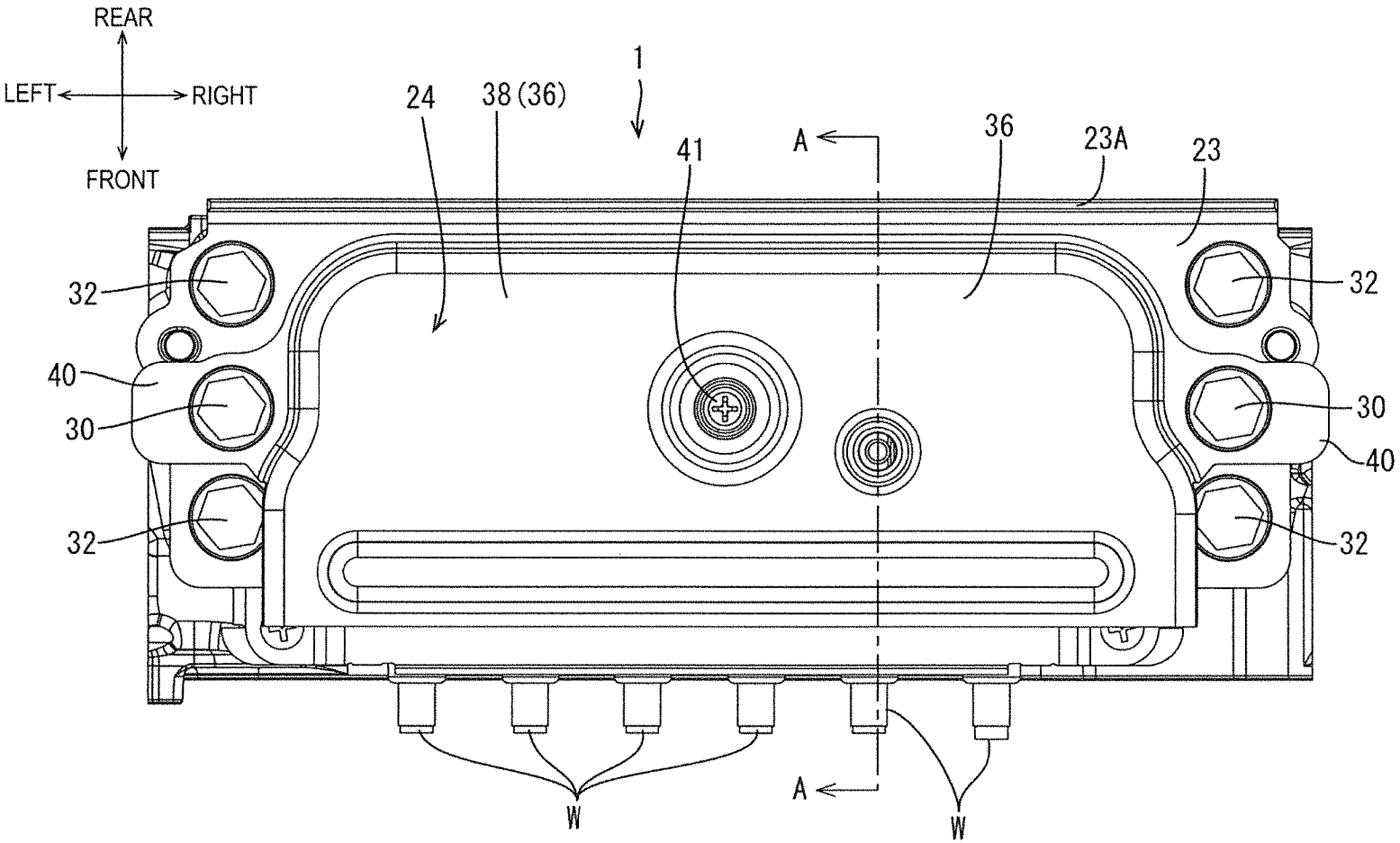
FIG. 1 is a top plan view of a connector according to the present embodiment.

With reference to FIG. 1, the outline of the connector 1 according to the present embodiment will be described. The connector 1 may be attached to the case of an inverter (an example of a device) mounted on a vehicle, such as an electric vehicle or a hybrid vehicle, to electrically connect the inverter and a three-phase motor (or a battery).

(1) Inverter Case

Figure 2:
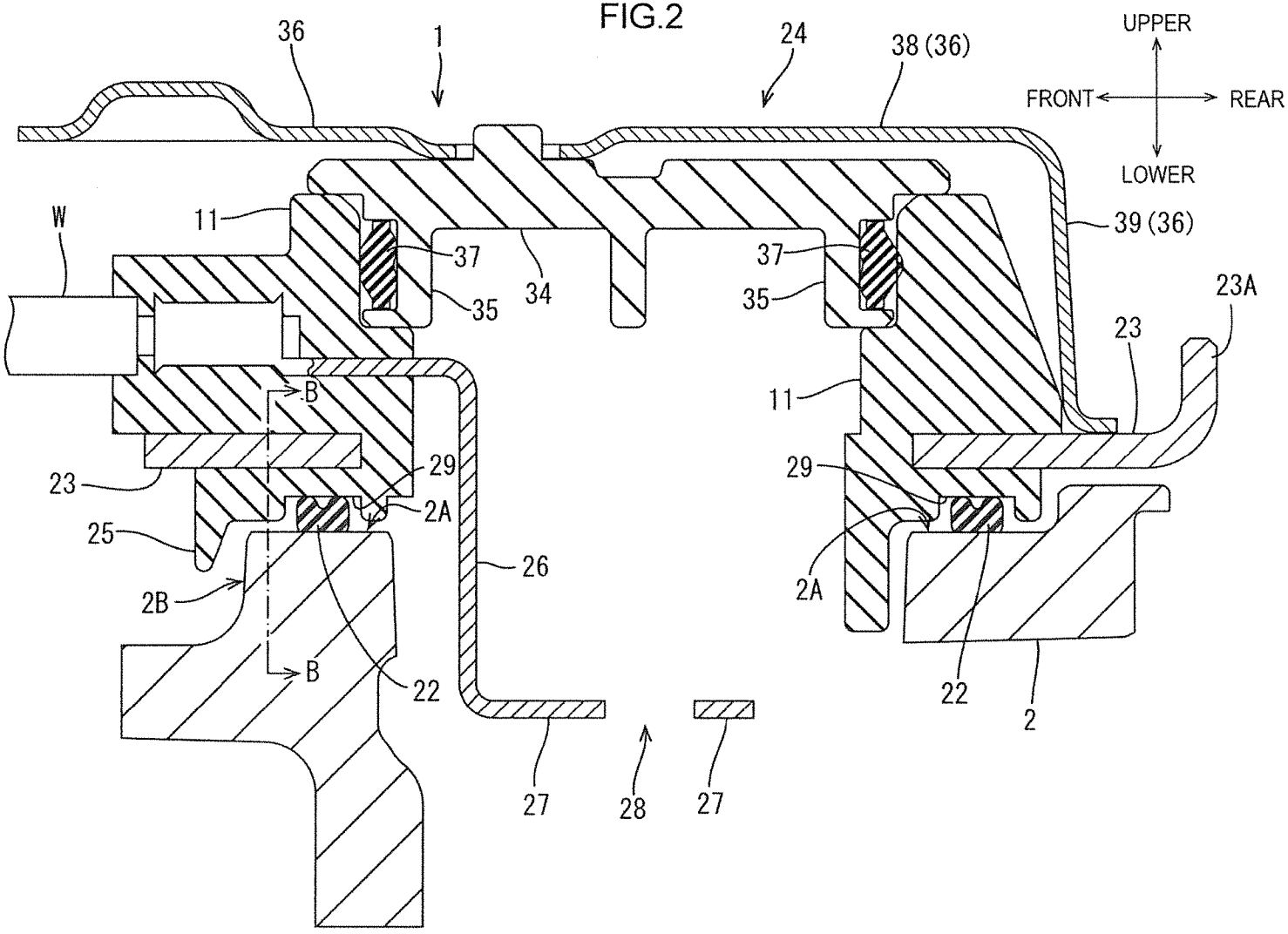
FIG. 2 is a cross sectional view of the connector and a device taken along line A-A of FIG. 1.

With reference to FIG. 2, an inverter case will be described. The inverter case is provided with an annular base portion 2 for attaching the connector 1. In the present embodiment, a surface 2A of the base portion 2 facing the upper side will be referred to as a seal press-contacted surface 2A. In the base portion 2, six terminal bolts, not illustrated, are provided extending upward.

(2) Connector Configuration

Figure 3:
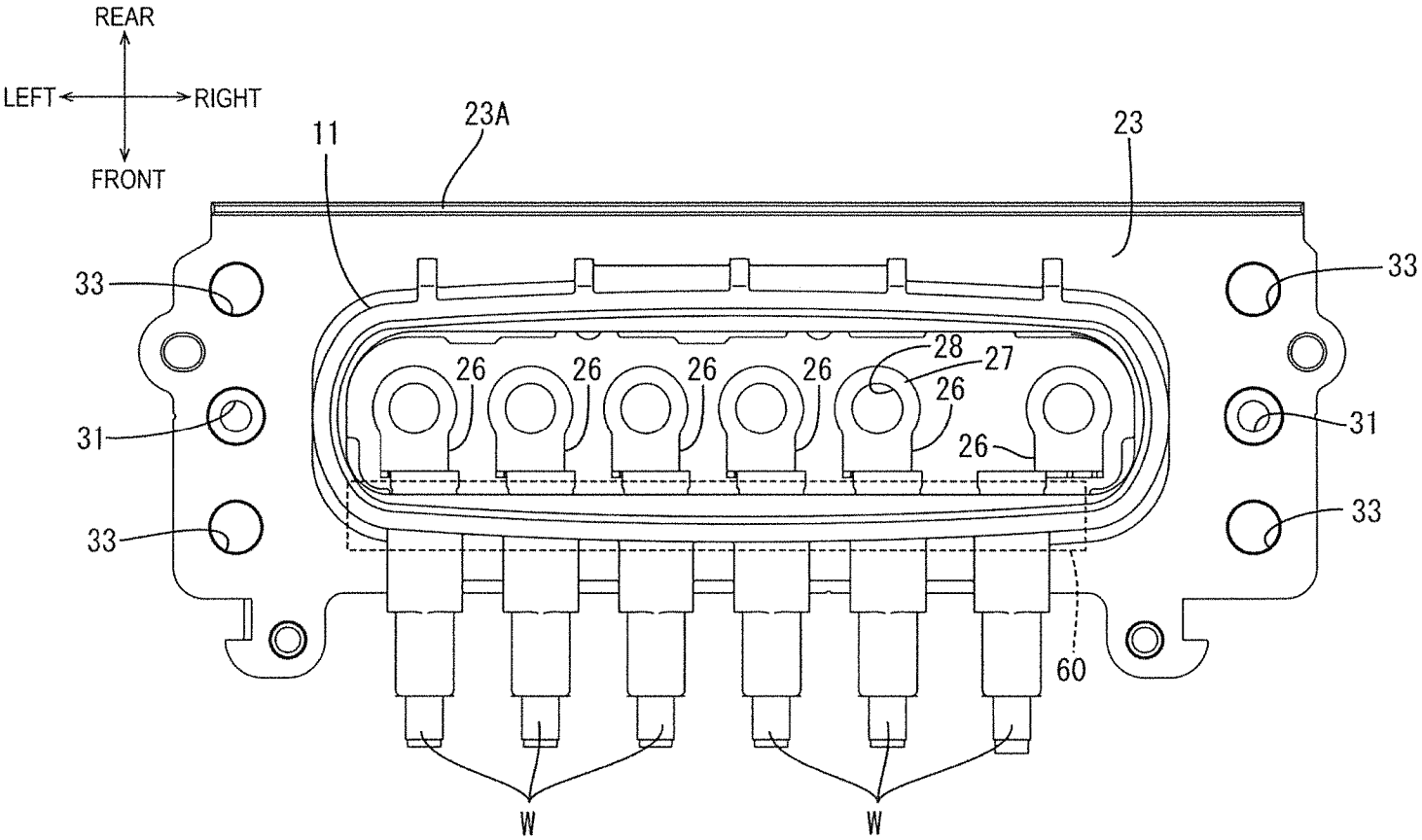
FIG. 3 is a top plan view of the connector with a seal cover removed.

With reference to FIG. 1 to FIG. 3, the configuration of the connector 1 will be described. The connector 1 includes an annular housing 11 (see FIG. 2 and FIG. 3); an annular surface packing 22 (see FIG. 2); a metal plate 23 (see FIG. 1 to FIG. 3); a seal cover 24 (see FIG. 1 and FIG. 2); and a water-preventing wall 25 (see FIG. 2). The surface packing 22 is an example of seal member.

As illustrated in FIG. 3, the housing 11 is a resin member constituted by a substantially elliptical wall. As illustrated in FIG. 2, the housing 11 is attached to the base portion 2 in such a position as to annularly rise from the base portion 2. As illustrated in FIG. 2, the housing 11 is open on both upper and lower sides.

As illustrated in FIG. 2 and FIG. 3, in the front side wall of the housing 11, a plurality of electric wires W are integrally molded by a molding process so as to penetrate through the wall in the front-rear direction.

As illustrated in FIG. 3, the electric wires W each have a terminal fitting 26 connected to the core wire at the distal end thereof, the other end being connected to a three-phase motor (or a battery) which is not illustrated. The terminal fitting 26 includes a contact portion 27 formed in a substantially circular plate shape. The contact portion 27 has a through-hole 28 penetrating therethrough in a plate thickness direction. The terminal fitting 26 is fixed to the terminal bolt by passing a terminal bolt through the through-hole 28 and threadedly engaging a nut with the terminal bolt.

As illustrated in FIG. 2, in the end surface of the housing 11 facing downward, a recess portion 29 recessed toward the upper side is formed all around. In the recess portion 29, a synthetic resin surface packing 22 is fitted. The surface packing 22 is provided to seal a space between the housing 11 and the base portion 2 in a watertight manner.

The metal plate 23 is a plate-shaped metal member formed with openings. As illustrated in FIG. 2, the housing 11 has an opening edge portion integrally molded all around by a molding process.

As illustrated in FIG. 3, the metal plate 23 includes bolt passing holes 33 for passing bolts 32 (see FIG. 1) for attaching the metal plate 23 to the base portion 2, and bolt passing holes 31 for passing bolts 30 (see FIG. 1) for attaching a shield case 36 to the base portion 2 via the metal plate 23 as will be described later, the bolt passing holes penetrating through the metal plate 23 in a plate thickness direction. The bolts 30, 32 are made to pass through the bolt passing holes 31, 33 and fastened to the base portion 2, whereby the metal plate 23 is fixed to the base portion 2 with the housing 11 being pressed all around toward the base portion 2.

The surface packing 22, as the housing 11 is pressed by the metal plate 23 toward the base portion 2, is compressed to be in close contact with both the housing 11 and the base portion 2. In this way, the space between the housing 11 and the base portion 2 is sealed in a watertight manner by the surface packing 22.

As illustrated in FIG. 3, the metal plate 23 is formed in a rectangular shape longer in the right-left direction, with a rib 23A formed along the edge portion constituting the long side on the rear side. The rib 23A is formed by bending a portion extending from the rear long side upward by substantially 90 degrees along the long side.

As illustrated in FIG. 3, the electric wires W are integrally molded in the front side wall of the housing 11, and extend from the housing 11 toward the front side. Thus, as viewed from the upper side (an example of a direction perpendicular to a plate surface of the metal plate), the electric wires W overlap the edge portion constituting the front long side of the metal plate 23. However, the electric wires W do not overlap the edge portion constituting the rear long side of the metal plate 23. That is, the rib 23A is provided along the edge portion, among the edge portions of the metal plate 23, which does not overlap the electric wires W as viewed from the upper side. The edge portion constituting the front long side is an example of an outer peripheral portion overlapping an electric wire. The edge portion constituting the rear long side is an example of an outer peripheral portion that does not overlap an electric wire.

On the other hand, the edge portion constituting the front long side of the metal plate 23, and the edge portions constituting the right and left short sides are not provided with a rib. The edge portion constituting the front long side is not provided with a rib because the electric wires W are pinched when the electric wires W are integrally molded in the housing 11 by a molding process.

Figure 4:
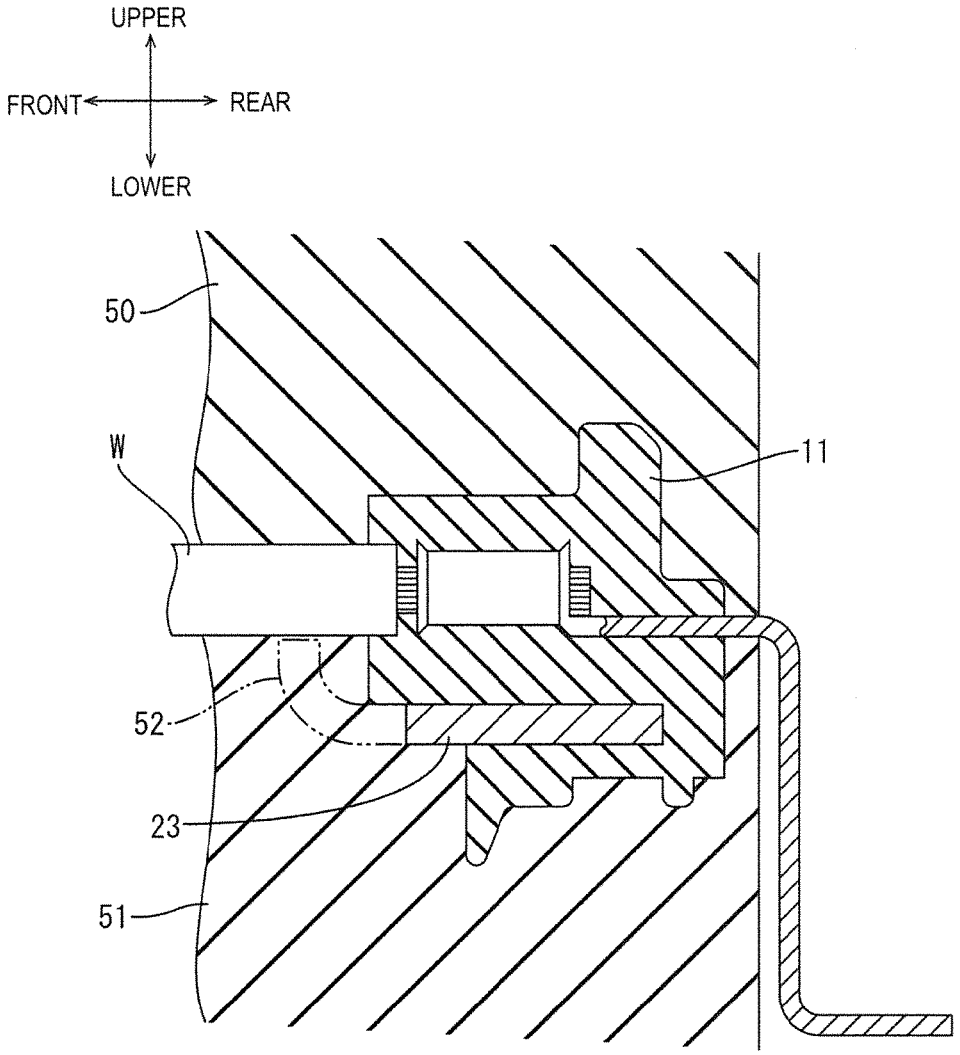
FIG. 4 is a cross sectional view for describing pinch.

Specifically, as illustrated in FIG. 4, when the electric wires W are integrally molded in the housing 11, it is necessary to strongly squeeze the electric wires W between upper and lower molds 50 and 51 so that the resin does not leak out of the gap between the upper and lower molds 50 and 51 and the electric wires W. In the present embodiment, the process of strongly squeezing the electric wires W between the upper and lower molds 50 and 51 is referred to as pinching.

When the electric wires W are pinched by the upper and lower molds 50 and 51, if a rib were to be also formed on the edge portion constituting the front long side, as indicated by dashed and double-dotted lines 52 in FIG. 4, the rib would pose an obstacle for squeezing the electric wires W from top and bottom. That is, it would become impossible to pinch the electric wires W. For this reason, the edge portion constituting the front long side of the metal plate 23 is not formed with a rib.

With reference to FIG. 2, the seal cover 24 will be described. The seal cover 24 includes a lid portion 34, a fitting portion 35, and the shield case 36. The lid portion 34 is a resin member covering the housing 11 from the upper side. The lid portion 34 has an outer peripheral shape which is substantially matched with the outer peripheral shape of the housing 11. The fitting portion 35 is disposed on the backside of the lid portion 34 so as to be able to be fit on the inside of the housing 11. In the outer peripheral surface of the fitting portion 35, a recess portion recessed all around is formed. In the recess portion, a resin axial seal 37 is fittingly mounted.

The shield case 36 is made of metal and includes an upper wall 38 substantially parallel with the plate surface of the metal plate 23; a rear wall 39 covering the rear side of the housing 11; a pair of side walls provided on the right and left; and a mounting plate 40 (see FIG. 1) extending from each side wall in parallel with the plate surface of the metal plate 23.

As illustrated in FIG. 1, the upper wall 38 is formed with a bolt passing hole for making a bolt 41 pass. As the bolt 41 is made to pass through the bolt passing hole and fastened to the lid portion 34, the shield case 36 is attached to the lid portion 34.

The mounting plate 40 is formed with bolt passing holes. Through the bolt passing holes of the mounting plate 40 and the bolt passing holes 31 of the metal plate 23, the bolts 30 are made to pass and fastened to the base portion 2, whereby the shield case 36 is fixed to the base portion 2.

With reference to FIG. 2, the water-preventing wall 25 will be described. The water-preventing wall 25 is provided to protect the surface packing 22 from high-pressure water externally sprayed toward the housing 11. The water-preventing wall 25 extends from the housing 11 toward the base portion 2 outside the surface packing 22.

Specifically, the water-preventing wall 25, with the housing 11 attached to the base portion 2, is provided at a position on the front side of an outer wall surface 2B on the front side of the base portion 2. The water-preventing wall 25, as viewed from the front side (an example of a direction perpendicular to a central axis of the seal member), shields the gap between the housing 11 and the base portion 2, and the edge portion of the outer wall surface 2B on the seal press-contacted surface 2A side.

With reference to FIG. 3, the range of the housing 11 in which the water-preventing wall 25 is provided will be described. The water-preventing wall 25 is not provided all around the housing 11. Instead, the water-preventing wall 25 is provided in at least a section in which the electric wires W are integrally molded in the circumferential direction of the housing 11. Specifically, since there are six electric wires W, there are six sections in which the electric wires W are integrally molded in the circumferential direction of the housing 11. Accordingly, in the present embodiment, the water-preventing wall 25 is provided in a continuous range including the six sections (the range indicated by dotted lines 60 in FIG. 3).

(3) Effects of the Embodiment

Because the connector 1 is provided with the water-preventing wall 25 for protecting the surface packing 22 from high-pressure water, the surface packing 22 can be prevented from being directly exposed to high-pressure water when the vehicle is washed using high-pressure water. Accordingly, the probability of the surface packing 22 becoming detached or degraded due to high-pressure water can be decreased.

In the connector 1, the water-preventing wall 25, with the housing 11 attached to the base portion 2, is provided at a position on the front side of the front side outer wall surface 2B of the base portion 2. As viewed from the front side (in a direction perpendicular to the central axis line of the surface packing 22), the water-preventing wall 25 shields the gap between the housing 11 and the base portion 2 and the edge portion of the outer wall surface 2B on the seal press-contacted surface 2A side. Accordingly, the surface packing 22 can be prevented from being directly exposed to water when high-pressure water is sprayed onto the connector 1 from the front side.

In the connector 1, the metal plate 23 has the rib 23A at the edge portion constituting the rear long side thereof (the edge portion that does not overlap the electric wires W as viewed in a direction perpendicular to the plate surface). On the other hand, the edge portion constituting the front long side (edge portion overlapping the electric wires W) does not have the rib. The water-preventing wall 25 is provided at least in a section in which the electric wires W are integrally molded in the circumferential direction of the housing 11. Accordingly, the surface packing 22 can be prevented from being directly exposed to water, and the electric wires W can be pinched, as will be described concretely below.

As described above, the surface packing 22 is compressed as the housing 11 is pressed toward the base portion 2 by the metal plate 23. In this case, if the stiffness of the metal plate 23 is insufficient, the housing 11 may become warped due to reaction force from the surface packing 22, and the gap between the housing 11 and the base portion 2 may become widened.

In the connector 1, the rib 23A is provided along the edge portion constituting the rear long side of the metal plate 23 (the edge portion not overlapping the electric wires W). Accordingly, the stiffness of the metal plate 23 is increased with respect to the edge portion constituting the rear long side. Thus, the housing 11 does not become easily warped with respect to the rear side, and the gap between the housing 11 and the base portion 2 can be prevented from becoming wider. In this way, the surface packing 22 can be prevented from being directly exposed to high-pressure water.

In the present embodiment, with the housing 11 not being warped, the surface packing 22 is virtually completely contained in the recess portion 29 so that the housing 11 and the base portion 2 are in close contact with each other. Accordingly, hardly any gap is produced between the housing 11 and the base portion 2, and the surface packing 22 can be virtually completely prevented from being directly exposed to high-pressure water.

No ribs are formed at the edge portions constituting the right and left short sides of the metal plate 23. However, because the right and left short sides are short compared with the front and rear long sides, the absence of the ribs does not readily lead to a decrease in the stiffness of the metal plate 23. Accordingly, hardly any gap is produced between the housing 11 and the base portion 2 also with respect to the right and left sides of connector 1.

Figure 5:
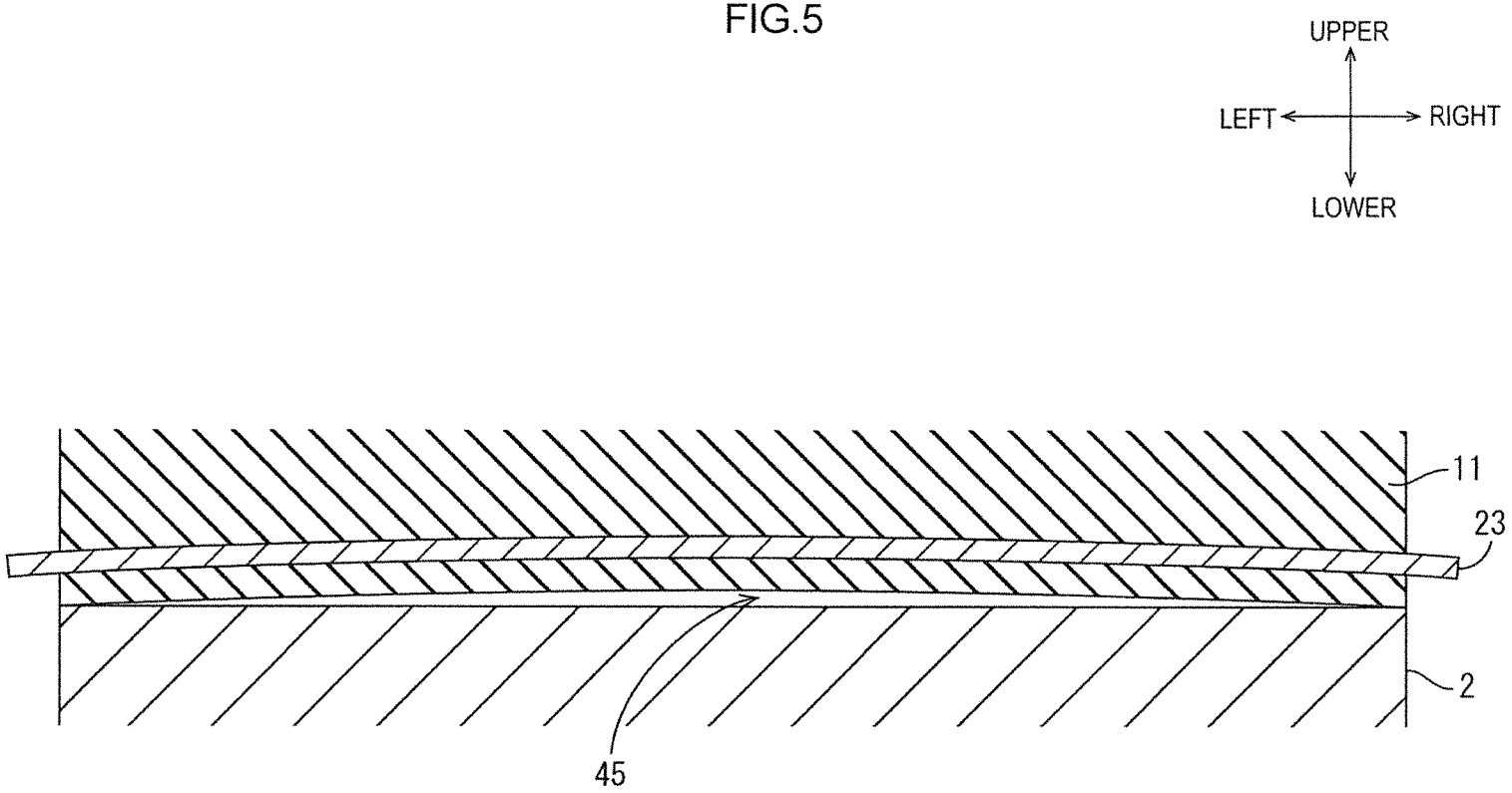
FIG. 5 is a cross sectional view taken along line B-B of FIG. 2.

Meanwhile, the edge portion constituting the front long side of the metal plate 23 (the edge portion overlapping the electric wires W) is not provided with a rib because of the pinching of the electric wires W. In addition, the front long side has a certain length in the right-left direction, resulting in a decrease in the stiffness of the metal plate 23. Consequently, as illustrated in FIG. 5, it is possible that the front side of the housing 11 could be deformed by reaction force from the surface packing 22 in such a way that generally the center in the right-left direction is warped upward, resulting in an increase in the gap 45 between the housing 11 and the base portion 2.

However, as described above, the housing 11 is provided with the water-preventing wall 25 at least in the section in which the electric wires W are integrally molded (the range indicated by the dotted lines 60 of FIG. 3 in the present embodiment) in the circumferential direction. Accordingly, even if the gap 45 between the housing 11 and the base portion 2 is increased, the surface packing 22 can be prevented from being directly exposed to high-pressure water. That is, the surface packing 22 can be prevented from being directly exposed to high-pressure water, and the electric wires W can be pinched.

OTHER EMBODIMENTS

The technology disclosed in the description is not limited to the above embodiment explained in the above description and the drawings. The following embodiments may be included in the technical scope disclosed in the present description, for example.

(1) The foregoing embodiment has been described with reference to the case in which the metal plate 23 is integrally molded in the housing 11. However, the metal plate 23 may not be integrally molded in the housing 11. For example, the metal plate 23 may be prepared separately from the housing 11, and the metal plate 23 may be attached to the base portion 2 while pressing a flange extending from the outer peripheral portion of the housing 11 toward the base portion 2.

(2) The foregoing embodiment has been described with reference to the case in which the connector 1 is provided with the metal plate 23. However, the connector 1 may not be provided with the metal plate 23. In this case, preferably the water-preventing wall 25 may be provided on the front and rear sides of, or all around, the housing 11.

(3) The foregoing embodiment has been described with reference to the case in which the metal plate 23 is provided with the rib 23A. However, the rib 23A may not be provided. In this case, the water-preventing wall 25 may preferably be provided on the front and rear sides of, or all around, the housing 11.

EXPLANATION OF SYMBOLS

1: Connector
2: Base portion (example of device)
2A: Seal press-contacted surface
2B: Outer wall surface
11: Housing
22: Surface packing (example of seal member)
23: Metal plate
23A: Rib
25: Water-preventing wall
W: Electric wire

The invention claimed is:

1. A connector that attaches to a device, the connector comprising:

an annular housing that attaches to the device in such a position as to annularly rise from the device;

an annular seal member that seals a space between an end surface of the housing facing the device and the device in a watertight manner; and a water-preventing wall that extends from the housing toward the device outside the seal member, and that protects the seal member from water externally sprayed toward the housing, wherein the housing is made of resin, the connector further comprising:

an electric wire integrally molded in the housing so as to penetrate through a wall of the housing;

a metal plate that is fixed to the device with the housing being all around pressed toward the device;

a rib provided along an outer peripheral portion of the metal plate, the outer peripheral portion not overlapping the electric wire as viewed in a direction perpendicular to a plate surface of the metal plate, wherein:

the metal plate does not have a rib in an outer peripheral portion overlapping the electric wire as viewed in the direction perpendicular to the plate surface; and the water-preventing wall is provided at least in a section in which the electric wire is integrally molded in the circumferential direction of the housing.

2. The connector according to claim 1, wherein the device includes a seal press-contacted surface that the seal member press-contacts, and an outer wall surface continuous with the seal press-contacted surface, and the water-preventing wall is provided at a position outside the outer wall surface with the housing attached to the device, and shields, as viewed in a direction perpendicular to a central axis of the seal member, a gap between the housing and the device, and an edge portion of the outer wall surface on the seal press-contacted surface side.

* * * * *